United States Patent [19]

Quinby, Jr.

[11] 4,281,832

[45] Aug. 4, 1981

[54] JUMP ROPE

[76] Inventor: Ripley Quinby, Jr., Box 176, Burlington, Vt. 05401

[21] Appl. No.: 131,509

[22] Filed: Mar. 18, 1980

Related U.S. Application Data

[63] Continuation of Ser. No. 973,460, Dec. 26, 1978, abandoned.

[51] Int. Cl.[3] ..... A63B 5/20

[52] U.S. Cl. ..... 272/75; 428/10

[58] Field of Search ..... 272/75, 74; 428/7, 10, 428/542; 15/222, 104.16, 104.165; 128/62 R

[56] References Cited

U.S. PATENT DOCUMENTS

| | | | |
|---|---|---|---|
| 336,149 | 2/1886 | Noyes | 428/10 X |
| 623,698 | 4/1899 | Beckh | 272/75 |
| 1,628,023 | 5/1927 | Adkins | 15/222 |
| 1,922,169 | 8/1933 | Martin | 272/75 X |
| 2,223,174 | 11/1940 | Hughes | 272/75 |
| 2,253,075 | 8/1941 | Johnson | 272/75 |
| 2,318,680 | 5/1943 | Ellinger | 15/222 |
| 2,505,610 | 4/1950 | Ellinger | 128/62 R X |
| 2,639,532 | 5/1953 | Seewald | 428/10 X |
| 3,268,938 | 8/1966 | Smith | 15/222 |
| 3,637,452 | 1/1972 | Sanders | 428/10 |

FOREIGN PATENT DOCUMENTS

| | | | |
|---|---|---|---|
| 559 | of 1902 | United Kingdom | 272/75 |

*Primary Examiner*—Richard C. Pinkham
*Assistant Examiner*—Arnold W. Kramer

[57] ABSTRACT

A jump rope featuring, in various aspects, a soft cushion element attached to a cord to prevent the cord from striking the ground, thereby decreasing noise; and a grip at each end of the cord including a ring attached to the cord, the cord being adjustably threaded through the ring to form a loop which can be increased or decreased in size to change the operative length of the rope.

3 Claims, 8 Drawing Figures

FIG 1
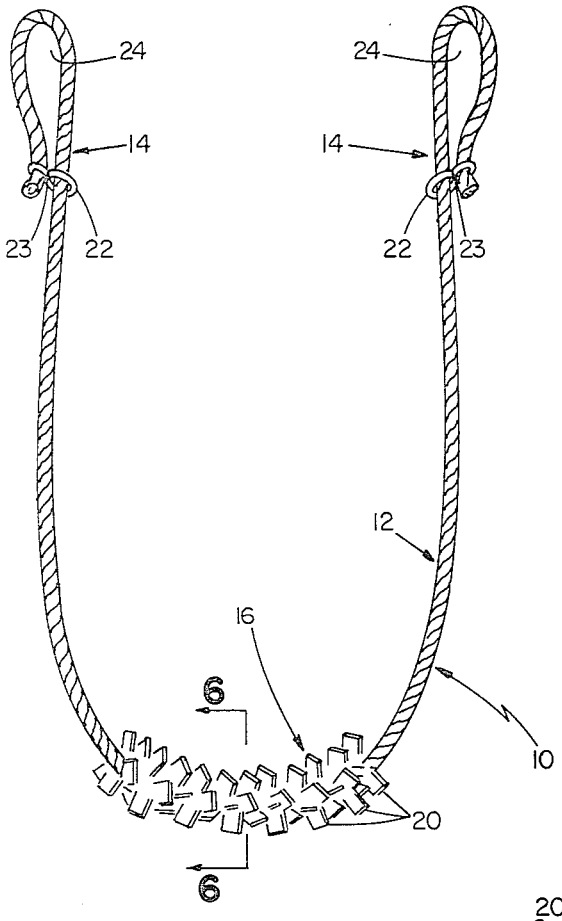
FIG 7
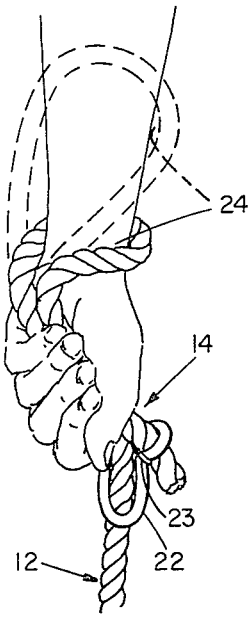
FIG 8
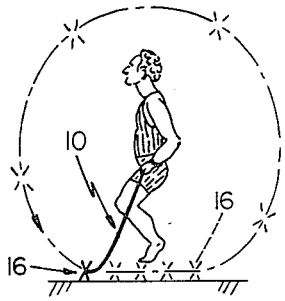
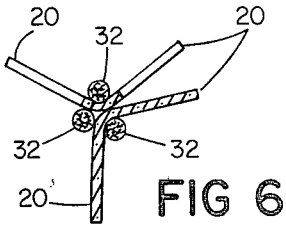
FIG 6
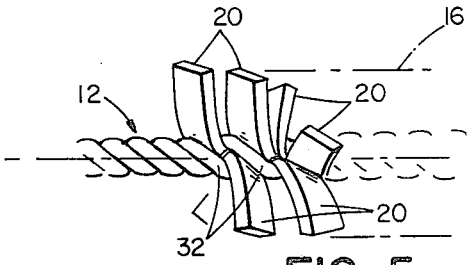
FIG 5
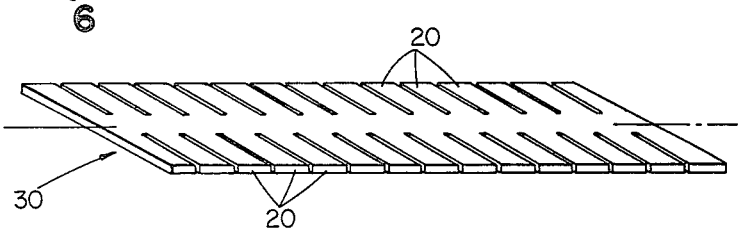
FIG 2
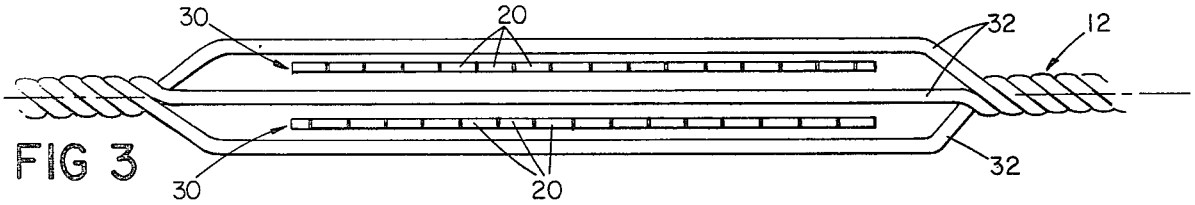
FIG 3
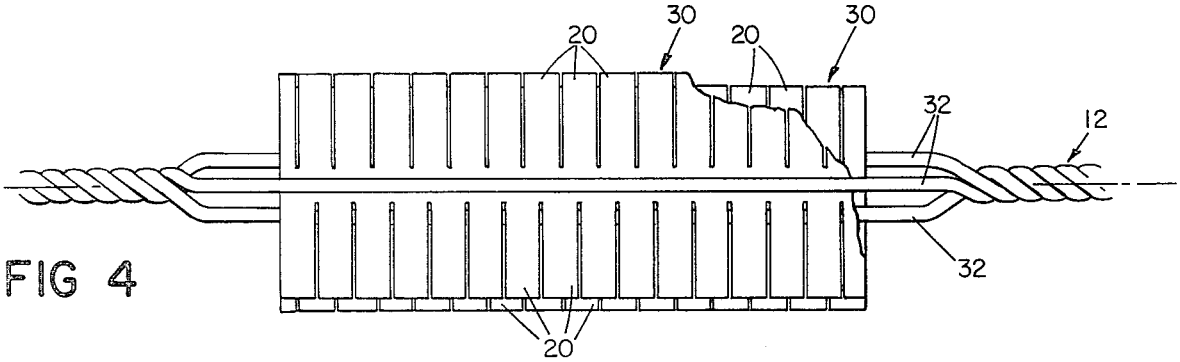
FIG 4

JUMP ROPE

This is a continuation of application Ser. No. 973,460, filed Dec. 26, 1978, and now abandoned.

FIELD OF THE INVENTION

My invention relates to exercise devices, and in particular to jump ropes.

BACKGROUND OF THE INVENTION

Such ropes are commonly used outdoors and in gymnasiums and other athletic facilities. However, it is most annoying when jump ropes are used in a residential building such as an apartment building, because the constant rapping of the rope against the floor is not tolerable by neighbors for even short periods of exercise.

Another problem with jump ropes is that they are not readily adjustable in length to accommodate different users. Cartwright et al. U.S. Pat. No. 2,723,121 shows a jump rope that adjusts through a hollow handle, the excess rope being drawn through the handle and wrapped about its outside.

SUMMARY OF THE INVENTION

My invention provides a jump rope which is virtually noise-free and which is easily adjustable in length.

In one aspect my invention features a jump rope having a cord having a longitudinal axis, grips at the ends of the cord, and a cushion element attached to the cord intermediate the grips, the cushion element being softer than the cord and extending sufficiently along the axis, so that when the rope is turned, the soft cushion element prevents the cord from striking the ground, thereby decreasing the noise that would otherwise occur. In preferred embodiments the cord has a plurality of strands, and the cushion element comprises serrated foamed plastic pads entwined between the strands to form outwardly extending fingers.

In another aspect my invention features a jump rope having a cord and grips at the end of the cord, each of the grips including a ring attached to the cord, the cord being adjustably threaded through the ring to form a loop which can be increased or decreased in size to change the operative length of the rope.

My jump rope is simple, inexpensive, and easy to construct. It enables the user to get a vigorous workout conveniently and quietly in his own home. It is easily adjustable in length to accommodate users of different height.

PREFERRED EMBODIMENT

I turn now to the structure and operation of a preferred embodiment, first briefly describing the drawings thereof.

DRAWINGS

FIG. 1 is a side elevation of a jump rope embodying the invention.

FIG. 2 is a perspective view of a pad, one of the parts of a cushion element of the jump rope of FIG. 1.

FIGS. 3–4 are respectively a side elevation and a plan view of the jump rope of FIG. 1 in an intermediate stage of construction.

FIG. 5 is a side elevation of a portion of the cushion element of the jump rope of FIG. 1.

FIG. 6 is a sectional view taken along 6—6 of FIG. 1.

FIG. 7 is a side elevation of a grip of the jump rope of FIG. 1 in use.

FIG. 8 is a schematic view of the jump rope of FIG. 1 in use.

STRUCTURE AND OPERATION

There is shown in FIG. 1 a jump rope 10 having a polypropylene cord 12 (9 feet long, ½ inch in diameter) having a longitudinal axis, grips 14 at each end of the cord, and a cushion element 16 attached to the cord intermediate the grips. The cushion element has a multiplicity of radially extending fingers 20 longitudinally and angularly positioned about the axis of the cord. The cord is threaded through rubber rings 22 (2 inches in diameter, 3/16 inch thick), attached by metal bands 23 to the ends of the cord, to form adjustable loops 24.

Turning now to FIG. 2, cushion element 16 comprises a pair of polyurethane foam pads 30 (only one shown in FIG. 2; each 15½ inches long, 5 inches wide, ⅜ inch thick), which are serrated to form fingers 20 (each approximately 2¼ inches long, 1 inch wide). As shown in FIGS. 3 and 4, during assembly, cord 12 is partially unwrapped, and pads 30 are positioned between the three strands 32 of the cord. The cord is then rewrapped, and the entwined pads twist, positioning the fingers angularly about the cord and causing them to extend radially outwardly (FIGS. 5 and 6). Conventional machinery can be used for the unwrapping and rewrapping.

In operation, the user passes a loop 24 over the back of each hand and grips the double thickness of cord 12 (FIG. 7). The size of the loop may be readily changed to adjust rope 10 to the desired overall length.

When rope 10 is turned (FIG. 8), the cushion element cushions the impact and prevents the harder cord from striking the ground, greatly decreasing the noise that would otherwise occur.

Advantageously, the fingers increase the effective diameter of the rope, causing the user to turn harder to overcome air resistance and to jump higher on each turn. This provides for a vigorous workout in a shorter period of time.

OTHER EMBODIMENTS

Other embodiments are within the scope of the following claims. For example, the loops could be padded for extra gripping comfort.

What is claimed is:

1. A jump rope comprising:

a cord having a longitudinal axis, grips at the ends of said cord, and cushion element means attached to said cord intermediate said grips, said cushion element means comprising a multiplicity of soft finger means longitudinally and angularly positioned about said axis and each extending outwardly therefrom with the base thereof attached to said cord, whereby the operative diameter of said rope is increased by the length of said outwardly extending finger means, and said cushion element means extending sufficiently along said axis, so that when said cord is turned by said grips, said cushion element means prevents said cord from striking the ground, thereby decreasing the noise that would otherwise occur, wherein said cord comprises at least three strands, and said cushion element means comprises at least two elongated serrated pads with the direction of elongation extending along the axis of the cord and with each pad positioned in a respective interstice between said strands and entwined therewith and with said soft finger means being formed by the serrations of said serrated pads.

2. The rope of claim 1 wherein each of said finger means extends at least an inch from said axis.

3. The jump rope of claim 1 wherein each of said grips include a ring attached to said cord, said cord being adjustably threaded through said ring to form a loop, whereby the size of said loop may be increased or decreased to change the operative length of said rope.

* * * * *